US008029389B2

(12) United States Patent
Chiu

(10) Patent No.: US 8,029,389 B2
(45) Date of Patent: Oct. 4, 2011

(54) BALL-HITTING TRAINER

(76) Inventor: Feng-Hsin Chiu, Taipei (TW)

( * ) Notice: Subject to any disclaimer, the term of this patent is extended or adjusted under 35 U.S.C. 154(b) by 0 days.

(21) Appl. No.: 12/692,646

(22) Filed: Jan. 24, 2010

(65) Prior Publication Data

US 2011/0183781 A1 Jul. 28, 2011

(51) Int. Cl.
*A63B 69/00* (2006.01)
*A63B 71/00* (2006.01)

(52) U.S. Cl. ..... 473/417; 473/451

(58) Field of Classification Search ..... 473/422, 473/417, 451; D21/718, 715
See application file for complete search history.

(56) References Cited

U.S. PATENT DOCUMENTS 2,616,692 A * 11/1952 Bird ..... 473/417
3,143,265 A * 8/1964 Ruderian ..... 294/142
3,183,000 A * 5/1965 Dix ..... 473/417
5,772,536 A * 6/1998 Wang ..... 473/417
5,897,444 A * 4/1999 Hellyer ..... 473/417
D430,243 S * 8/2000 Alberti et al. ..... D21/715
6,616,554 B2 * 9/2003 Liao ..... 473/417
6,884,185 B2 * 4/2005 Udwin et al. ..... 473/417
7,704,168 B1 * 4/2010 Hochberg ..... 473/417
2010/0056306 A1 * 3/2010 Chen ..... 473/417

* cited by examiner

*Primary Examiner* — Mitra Aryanpour
(74) *Attorney, Agent, or Firm* — PAI Patent & Trademark Law Firm; Chao-Chang David Pai

(57) ABSTRACT

A ball-hitting trainer is provided with a base combined with a flexible shaft that may bend in all directions. The flexible shaft is structured with a helical spring and a flexible wire. The flexible wire is wound around an outside gap of the helical spring so as to make the flexible wire helical and wrap the whole helical spring. The body of flexible shaft is covered by a plurality of shock absorbers, and a free end of the flexible shaft is connected to a cup-shaped body; thus the ball-hitting trainer is formed and a ball may be placed in the cup-shaped body for practice of ball hitting.

5 Claims, 7 Drawing Sheets

BALL-HITTING TRAINER

BACKGROUND OF THE INVENTION (a) Field of the Invention

This invention relates to a ball-hitting trainer and particularly to a ball hitting trainer designed for people who practice hitting balls or who play for fun.

(b) Description of the Prior Art

A conventional ball-hitting trainer is a machine that is provided to practice to wave a bat and strike, and may also be an interesting game machine. A professional ball hitting trainer is bulky and complicated that may shoot baseballs or softballs for a user to hit for practice, so the manufacturing cost is higher, the operation modes are numerous, and it is not suitable for children and ordinary people. The ball-hitting trainer like the game machine carries on the head the baseball or softball or hangs it at a stationary position for the user to strike for practice, as disclosed, for example, in U.S. Pat. No. 4,191,372 or 5,100,134. However, the conventional ball-hitting trainer used for the game merely carries on the head the baseball or softball or hangs it at a height of position, which is difficult in adjusting the position and height in the 3D space, so it cannot meet the requests of people of all ages; for example, due to the heights of a child and a teenager that are different, the trainer is not practical. Besides, when the bat hits a portion where the ball is carried or hanged, the trainer or the ball bat is easily damaged. Thus, the conventional ball-hitting trainer used for the game must still be improved for the structure.

Consequently, because of the technical defects of described above, the applicant keeps on carving unflaggingly through wholehearted experience and research to develop the present invention, which can effectively improve the defects described above.

SUMMARY OF THE INVENTION

This invention is mainly to provide a ball-hitting trainer. The ball-hitting trainer is provided with a base combined with a flexible shaft that may bend in all directions. The flexible shaft is structured with a helical spring and a flexible wire. The flexible wire is wound around an outside gap of the helical spring so as to make the flexible wire helical and wrap the whole helical spring and combine a cup-shaped body at a free end of the flexible shaft, and thus the baseball or softball may be placed in the cup-formed part, thereby the user being allowed to significantly adjust the height and position in all directions to strike for practice.

This invention is further to provide the ball-hitting trainer, in which the flexible shaft is put around a plurality of shock absorbers. The plurality of shock absorbers are provided with hollow parts having a plurality of thru holes that may absorb an impact load caused by a hit of a bat on the flexible shaft, thereby protecting the ball-hitting trainer and the bat.

DETAILED DESCRIPTION OF THE PREFERRED EMBODIMENTS

Figure 1:
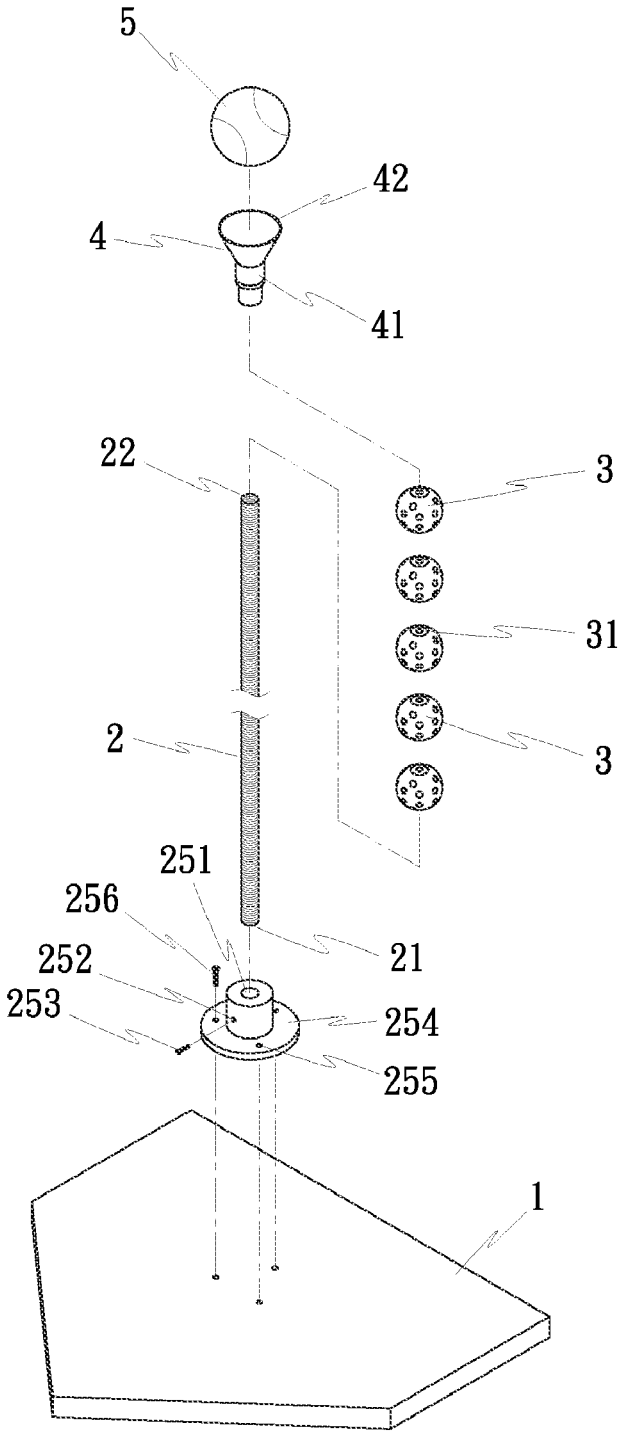
FIG. 1 is a 3D exploded view of a ball-hitting trainer according to this invention.

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

As shown in the figure, a ball-hitting trainer according to this invention is made up of a base 1, a flexible shaft 2, a plurality of shock absorbers 3, and a cup-shaped body 4 in which a ball 5 may be positioned for play or hitting practice.

Figure 2:
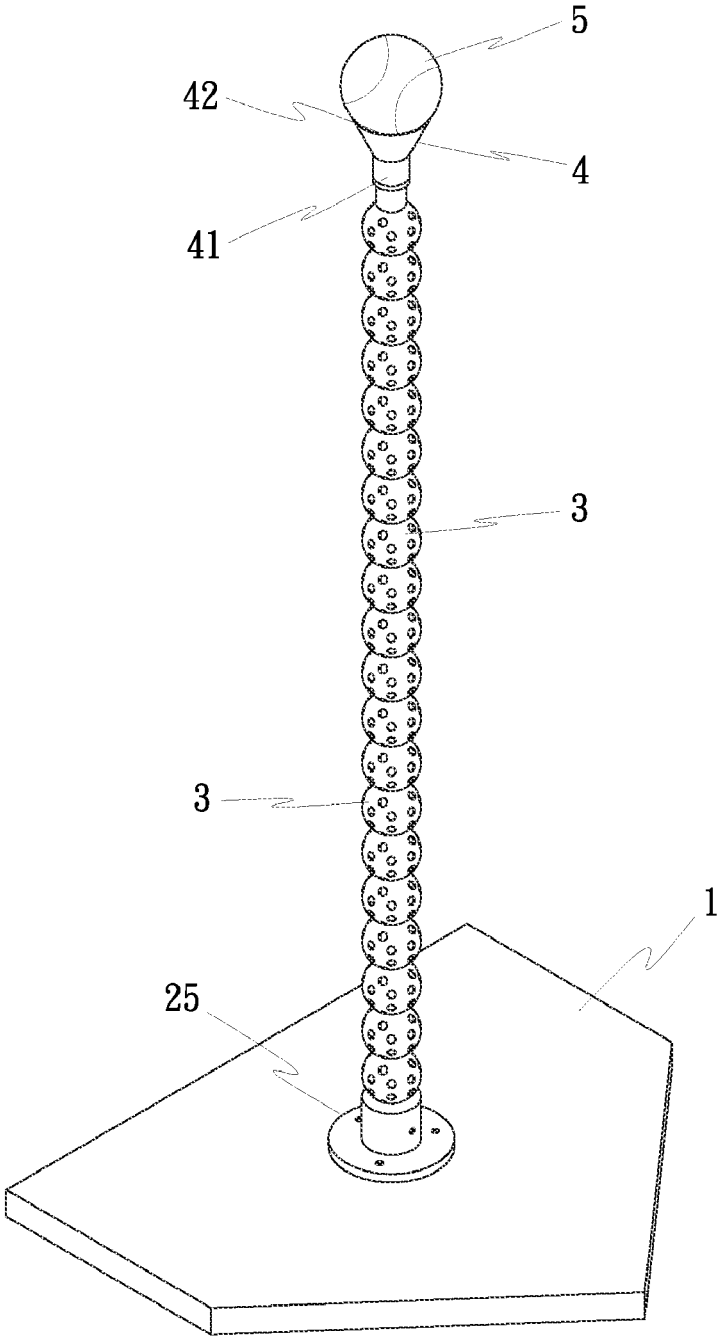
FIG. 2 is a 3D assembly view of the ball-hitting trainer according to this invention.

The base 1, as shown in FIGS. 1 and 2, is used to fix or support a seat of the flexible shaft 2, but not limited to a specific structure of a shape.

Figure 3:
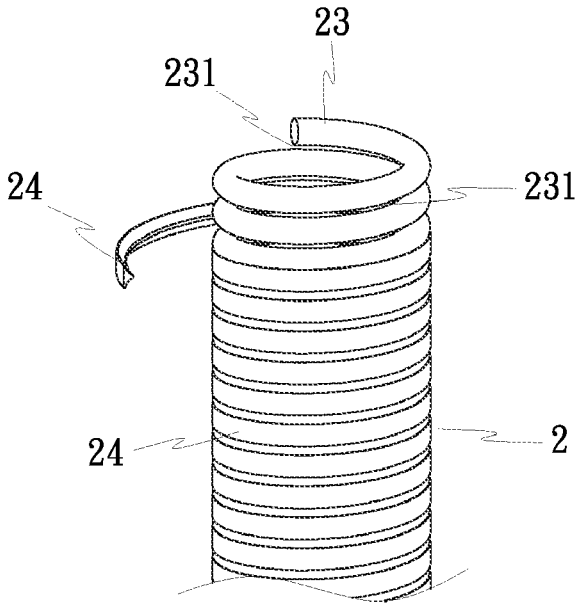
FIG. 3 is a 3D view of the partial structure of a flexible shaft according to this invention.
Figure 4:
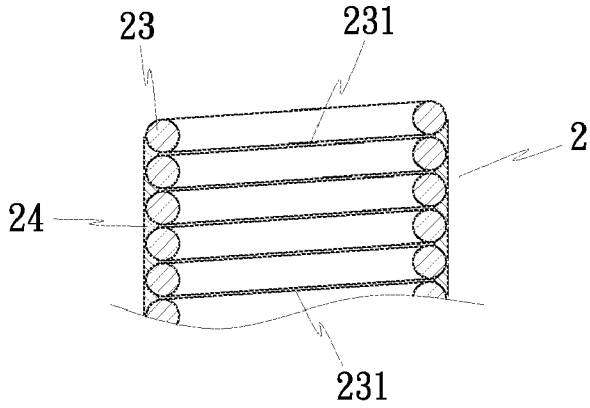
FIG. 4 is a 3D sectional view of the partial structure of flexible shaft according to this invention.
Figure 5:
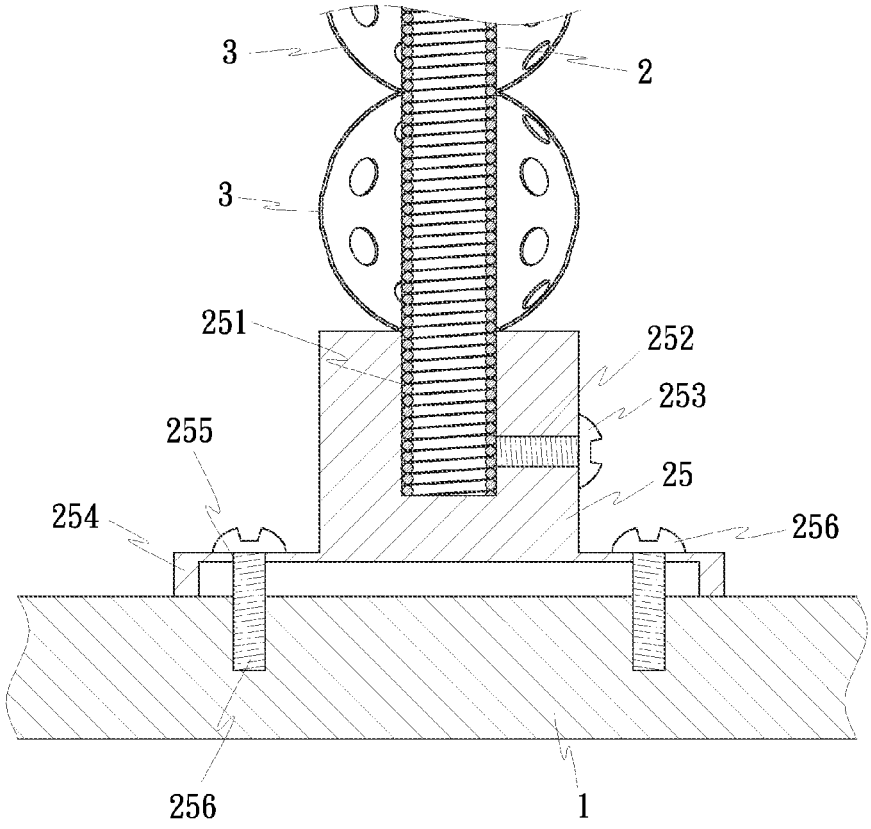
FIG. 5 is a sectional view illustrating the assembly state of a stationary part according to this invention.

The flexible shaft 2, as shown in FIGS. 1 and 2, is a long rod that may be bent in all directions for adjustment and be constantly bent, and is provided with a fixing end 21 connected to the base 1, and a free end 22 connected to the cup-shaped body 4. As shown in FIGS. 3 and 4 the flexible shaft 2 may be structured with a helical spring 23 and a flexible wire 24. The flexible wire 24 is wound around an outside gap 231 of the helical spring 23 so as to make the flexible wire 24 helical and wrap the whole helical spring 23, thereby the flexible shaft can be bent in all directions into various forms. As shown in FIGS. 1, 2, and 5, the fixing end 21 may be connected to a stationary part 25. A concave hole 251 for insertion by the flexible shaft 2 is formed in the center of the stationary part 25. A screw hole 252 and a screw 253 are provided at a side of the concave hole 251 so as to make the screw 253 fix the flexible shaft 2. A protruding ring 254 is provided at the bottom of stationary part 25. A plurality of thru holes 255 are formed on the surface of the protruding ring 254, and each thru hole 255 is formed with a screw 256 to be locked with the base 1.

Figure 6:
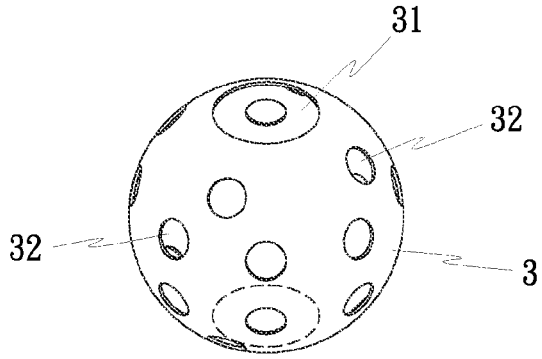
FIG. 6 is a 3D view of a shock absorber according to this invention.

The plurality of shock absorbers 3, as shown in FIGS. 1 and 6, are provided with hollow parts having thru holes 31, and several holes 32 are formed around the shock absorbers 3. Thus, with the thru holes 31, the plurality of shock absorbers 3 are put around the body of the flexible shaft 2, as shown in FIG. 2, so that the flexible shaft 2 is combined with the string of shock absorbers 3.

Figure 7:
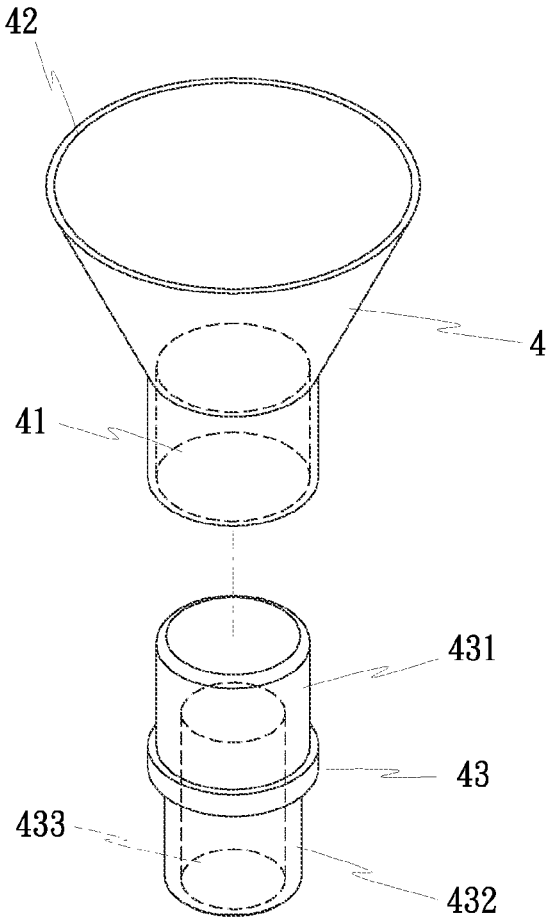
FIG. 7 is a 3D view of a cup-shaped body and a link part according to this invention.

One end of the cup-shaped body, as shown in FIGS. 1 and 2, is a connection portion 41 connected to the free end 22 of flexible shaft 2, while the other end is formed with a cup mouth 42 where a ball 5 may be placed. As shown in FIG. 7, the connection portion 41 is provided with a link part 43 structured into a pillar of which an upper section 431 connected to the cup-shaped body 4, and a concave hole 433 is formed in the center of a lower section 432 to connect the concave hole 433 with the free end 22 of flexible shaft 2.

Figure 8:
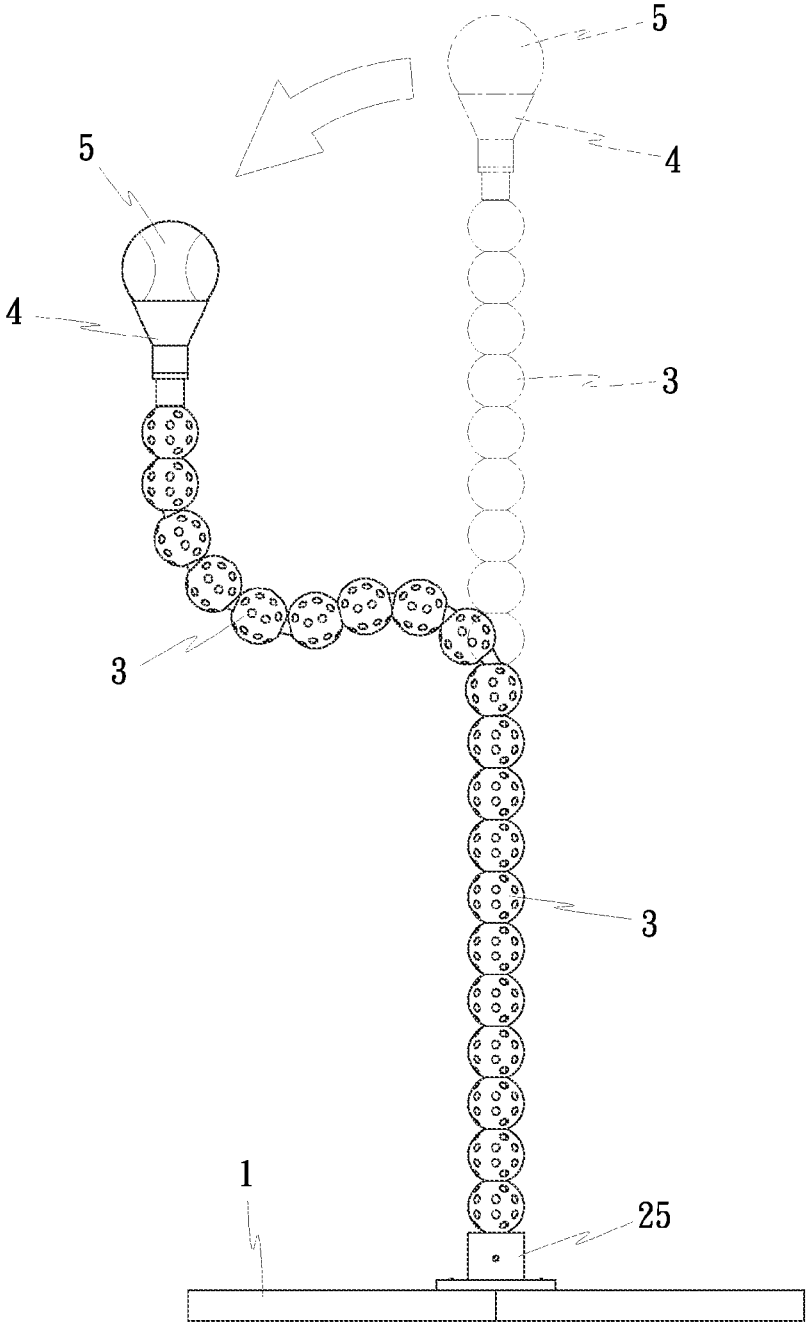
FIG. 8 is a schematic view illustrating the implementation of a state of this invention.
Figure 9:
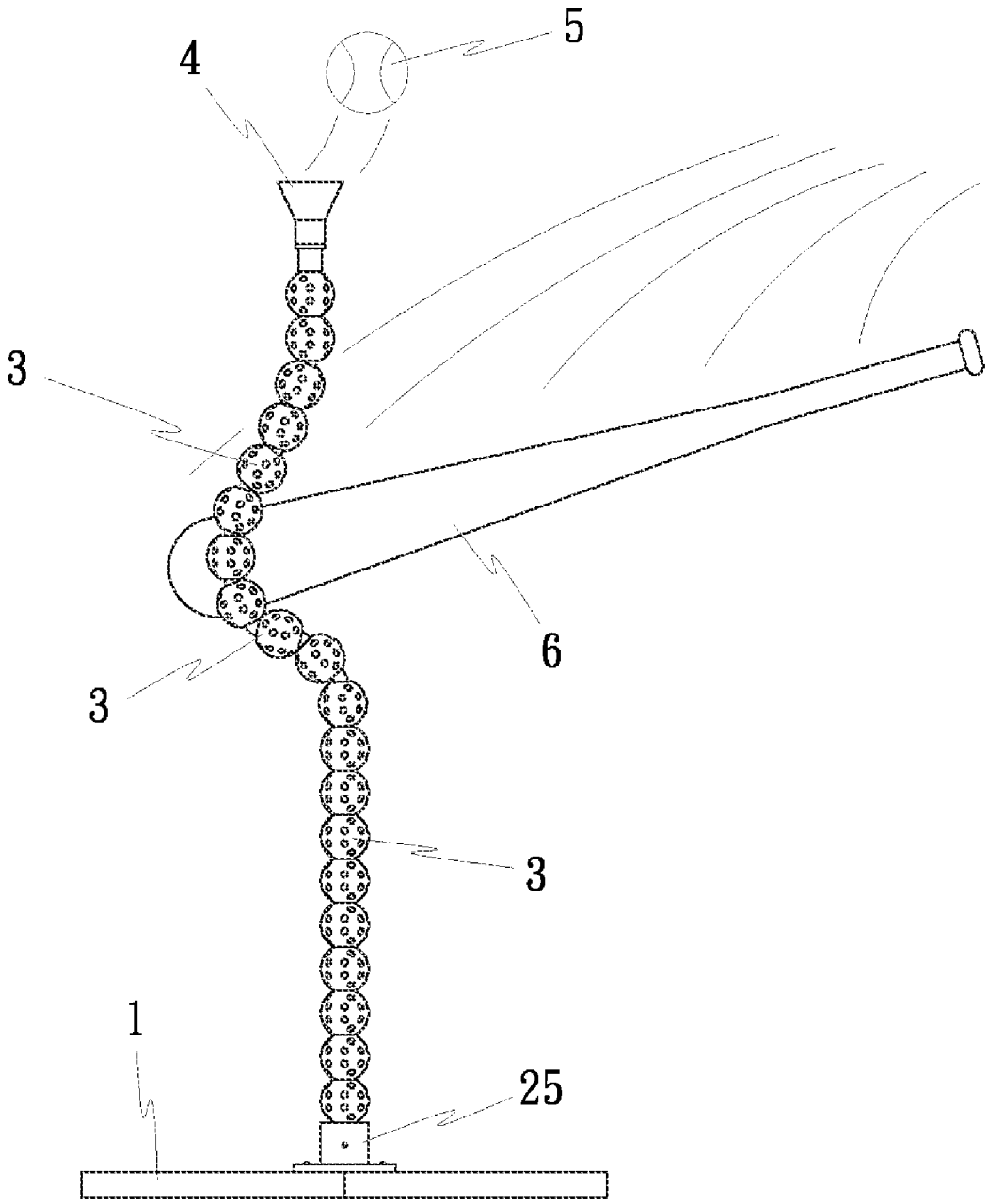
FIG. 9 is a schematic view illustrating the implementation of a motion of this invention.

The base 1, the flexible shaft 2, the plurality of shock absorber 3, and the cup-shaped body 4 is structured into the ball-hitting trainer. At the time of implementation, as shown in FIG. 8, the ball 5 is placed in the cup mouth 42 of the cup-shaped body 4 at a height for the user's practice on ball hitting. In this invention, the flexible shaft 2 that may be bent in all directions is provided, as shown in FIG. 8, to adjust the cup-shaped body 4 and the ball 5 at a random position in the 3D space; thus, it is suitable for the users of all ages and heights to practice on ball hitting. Especially, the flexible shaft 2 that is made up of a helical spring 23 and a flexible wire 24 may be bent at a larger range and may be flexibly bent in all directions into various shapes and requirements. Further, the helical spring 23 and the flexible wire 24 are made of metal so as to make the whole flexible shaft 2 flexible, as shown in FIG. 9; proper bending is achieved, when the user strikes by mistake, and the impact on the bat 6 may be absorbed. Next, the flexible shaft 2 is covered by the plurality of shock absorbers 3 to reduce the impact caused by the bat 6 and then prevent the bat 6 from being scratched and damaged and fully protect the whole ball-hitting trainer.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A ball-hitting trainer, comprising:

a base;

a flexible shaft made up essentially entirely of a helical spring and a flexible wire, in which the flexible wire is wound around an outside gap of the helical spring and a fixing end of the flexible shaft is connected to the base; and a cup-shaped body provided with a connection portion connected directly to the free end of the flexible shaft and a cup mouth for holding a ball.

2. The ball-hitting trainer according to claim 1, wherein the flexible shaft is connected to a plurality of shock absorbers, each of which is a hollow part provided with a thru hole, through which the flexible shaft is inserted.

3. The ball-hitting trainer according to claim 1, wherein the fixing end of flexible shaft is connected to a stationary part provided with a concave hole into which the flexible shaft is inserted, and a screw hole and a screw fixing the flexible shaft are provided at a side of the concave hole.

4. The ball-hitting trainer according to claim 1, wherein the connection portion of the cup-shaped body is formed with a link part being in a shape of pillar of which an upper section is connected to the cup-shaped body and a lower section is provided with a concave hole connected to the free end of the flexible shaft.

5. The ball-hitting trainer according to claim 2, wherein each of the plurality of shock absorbers further comprises a plurality of holes formed around the hollow part.

* * * * *